US006388216B1

(12) United States Patent
Puhalla et al.

(10) Patent No.: US 6,388,216 B1
(45) Date of Patent: May 14, 2002

(54) TERMINAL WIRE CLAMP

(75) Inventors: Craig Joseph Puhalla, Moon Township; David Curtis Turner, Imperial; Roger William Helms, Beaver Falls, all of PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/795,553

(22) Filed: Feb. 28, 2001

(51) Int. Cl.[7] ..... H01H 1/00
(52) U.S. Cl. ..... 200/284; 361/634; 439/781
(58) Field of Search ..... 200/284; 361/634, 361/635, 636, 669, 670, 672, 822; 439/781, 782, 801, 811

(56) References Cited

U.S. PATENT DOCUMENTS 3,144,506 A * 8/1964 Gunthel, Jr. ..... 174/71
3,470,526 A * 9/1969 Joly ..... 339/246
3,509,521 A * 4/1970 Gutshall ..... 339/246
5,415,558 A * 5/1995 Baker ..... 439/210
5,498,264 A * 3/1996 Schlapfer et al. ..... 606/72
5,692,930 A * 12/1997 Garver et al. ..... 439/781
5,752,860 A * 5/1998 Greaves ..... 439/781
5,978,208 A 11/1999 Helms et al.
6,045,414 A * 4/2000 DeFrance ..... 439/794

* cited by examiner

*Primary Examiner*—Lincoln Donovan
*Assistant Examiner*—Kyung S. Lee
(74) *Attorney, Agent, or Firm*—Martin J. Moran

(57) ABSTRACT

A terminal wire clamp is provided with a fastener and a connection plate, in which the connection plate has a connection surface that is formed with a retention channel, and in which the retention channel is structured to receive a wire therein and resist movement of the wire after the wire has electrically conductively engaged a conductor. The abstract shall not be used for interpreting the scope of the claims.

13 Claims, 3 Drawing Sheets

TERMINAL WIRE CLAMP

BACKGROUND OF THE INVENTION

1. Field of the Invention

The present invention relates generally to power distribution equipment and, more particularly, to a clamp for clamping a wire to a conductor of a circuit breaker.

2. Description of the Related Art

Numerous types of circuit breakers are known and understood in the relevant art. Among the purposes for which circuit breakers are provided is to interrupt electrical current on command or under certain defined circumstances. Generally stated, most circuit breakers include a line conductor connected with a power source and a load conductor connected with an electrical load, and further include a current interruption system interposed between the line conductor and the load conductor to interrupt current as needed. The current interruption system typically includes an operating mechanism that separates a set of separable electrical contacts to interrupt current from flowing therethrough, and further includes a trip unit operatedly connected with the operating mechanism. The trip unit triggers the operating mechanism to separate the electrical contacts during the specified overcurrent, undervoltage, or other conditions. In multi-phase circuit breakers, the operating mechanism typically includes a crossbar that simultaneously separates several sets of separable contacts to simultaneously interrupt current through all of the phases of the circuit breaker.

In many power distribution systems, the electrical load is in the form of a wire that is connected with the load conductor. Moreover, depending upon the configuration of the circuit breaker, the power source can likewise be in the form of a wire that is connected with the line conductor of the circuit breaker. Known wires typically are either of a solid or stranded configuration, both of which have an elongated cylindrical configuration. In order to electrically conductively connect such wires with the load and/or line conductors of the circuit breaker, the wire must be engaged against the conductors with an appropriate clamp. While numerous types of clamps are generally known, such clamps have not, however, been without limitation.

As is known in the relevant art, line and load conductors of circuit breakers are generally of an elongated configuration with a rectangular cross section such that the conductor provides a substantially planar engagement surface against which the clamp electrically conductively engages the wire. Such clamps typically each include a fastener and a connection plate, whereby the fastener in configured to apply appropriate forces through either or both of the clamp and the conductor to electrically conductively engage the wire with the conductor. The clamps typically are structures that are separate and independent of both the circuit breaker and the conductor, and are made as separate components for reasons of versatility and cost-effectiveness, as well as for other purposes.

The separate nature of the clamp undesirably permits the connection plate thereof to be movable with respect to the conductor such that a connection surface of the connection plate can become non-parallel with the engagement surface of the conductor, as can be seen generally in FIG. 1. Such a non-parallel relationship typically results from a shifting of the clamp with respect to the conductor during and/or subsequent to tightening the fastener. Non-parallel situations almost always occur during tightening of the fastener when the fastener is centrally disposed on the clamp and only a single solid wire is electrically conductively engaged with the conductor. Such a non-parallel relationship between the engagement surface and the connection surface increases the likelihood that the wire may eventually become undesirably loosened from between the conductor and the connection plate and thus less than fully electrically engaged with the conductor, which can result in arcing and a hot spot.

As can be understood from the conductor and clamp arrangement depicted in FIG. 1, the conductor C and the connection plate I both apply forces normal thereto to the wire W when the fastener F is tightened. Since the conductor C and the connection plate I are non-parallel, the normal forces, when combined, provide a resultant force on the wire W in a direction away from the fastener F. The normal forces also create frictional forces that resist movement of the wire W in the aforementioned direction away from the fastener. Depending upon the configuration of the conductor C, the connection plate I, and the wire W, the wire W will tend to become loosened from between the conductor C and the connection plate I if the resultant force on the wire overcomes the frictional forces applied thereto. It is thus desired to provide a clamp having a connection plate that is specifically configured such that the resultant force on the wire does not overcome the frictional or other retentive forces on the wire W, which advantageously will resist the wire W from becoming loosened or less than fully electrically conductively engaged with the conductor C.

SUMMARY OF THE INVENTION

In accordance with the foregoing, a terminal wire clamp is provided with a fastener and a connection plate, in which the connection plate has a connection surface that is formed with a retention channel, and in which the retention channel is structured to receive a wire therein and resist movement of the wire after the wire has electrically conductively engaged a conductor.

An object of the present invention is to provide an improved clamp for use in electrically conductively engaging a wire with a conductor.

Another object of the present invention is to provide a clamp formed with a retention channel that is structured to receive a wire therein and resist movement of the wire after the wire has electrically conductively engaged a conductor.

Another object of the present invention is to provide a clamp having a connection plate and a fastener, in which the connection plate is formed with a retention channel that is offset from the fastener.

Another object of the present invention is to provide a circuit breaker having a conductor and a clamp, in which the clamp is formed with a retention channel and is structured to electrically conductively engage a wire with the conductor, the retention channel being structured to resist movement of the wire after the wire has engaged the conductor.

As such, an aspect of the present invention is to provide a terminal wire clamp structured to electrically conductively engage a wire with a conductor, the general nature of which can be stated as including a fastener and a connection plate, the fastener and connection plate being cooperable with one another to electrically conductively engage the wire with the conductor, the connection plate having a connection surface, the connection surface including a first retention channel formed into the connection plate, and the connection surface is structured to engage the wire and at least partially receive the wire in the first retention channel, with the first retention channel being structured to resist movement of the wire when the connection plate engages the wire with the conductor.

The connection plate may include an engagement member having a primary portion and a first rib, with the primary portion including a substantially planar primary surface, and with the first rib including an elongated first rib surface, the first rib surface protruding outwardly from the primary surface and extending at least partially in a direction non-parallel with the first retention channel. In such a configuration the connection surface includes the primary surface and the first rib surface, with the first retention channel being formed into the first rib.

The engagement member may include a second rib, with the second rib having an elongated second rib surface protruding outwardly from the primary surface, in which the first retention channel is formed across both the first and second ribs. The first and second retention channels are advantageously tangent to the primary surface. The first and second ribs may be first and second embossments.

Another aspect of the present invention is to provide a circuit breaker, the general nature of which can be stated as including a line conductor, a load conductor, an operating mechanism operatively interposed between the first and second conductors, and a terminal wire clamp structured to electrically conductively engage a wire with one of the line and load conductors, in which the terminal wire clamp includes a fastener and a connection plate that are cooperable with one another, and in which the connection plate has a connection surface including a first retention channel formed into the connection plate. The terminal wire clamp is structured to cooperate with a fastener to engage the wire with the conductor, and the connection surface is structured to engage the wire and at least partially receive the wire in the first retention channel, with the first retention channel being structured to resist movement of the wire when the connection plate engages the wire with the one of the line and load conductors.

BRIEF DESCRIPTION OF THE DRAWINGS

A further understanding of the invention can be gained from the following description of the preferred embodiment when read in conjunction with the accompanying drawings in which.

Similar numerals refer to similar parts throughout the specification.

DESCRIPTION OF THE PREFERRED EMBODIMENT

Figure 1:
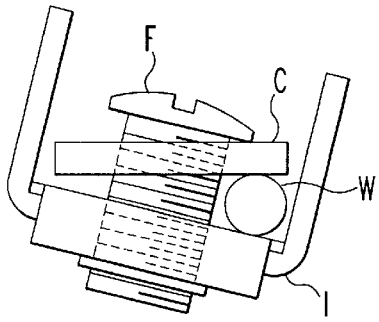
FIG.1 PRIOR ART
FIG. 1 is a view of a prior art terminal wire clamp and a conductor in which a wire has become at least partially electrically disengaged from the conductor subsequent to initial electrically conductive engagement therebetween.

A terminal wire clamp 4 in accordance with the present invention is indicated generally in FIGS. 1A and 3–8. The terminal wire clamp 4 can broadly be said to include a fastener 8 and a connection plate 12, and is advantageously employed to connect a wire 16 (FIG. 8) with a circuit breaker 20 (FIG. 2). More specifically, the terminal wire clamp 4 is advantageously configured to avoid undesired loosening or partial disengagement of the wire 16 from the circuit breaker 20 after the terminal wire clamp 4 has been tightened.

As can be understood from FIG. 2, the circuit breaker 20 may be any of a wide variety of circuit breakers having a case 24 that carries a line conductor 28 and a load conductor 32, with an operating mechanism 36 being operatively interposed between the line and load conductors 28 and 32. As can best be seen in FIG. 8, the load conductor 32 is of a substantially rectangular cross section and is formed with an attachment hole 38 extending therethrough. As will be set forth more fully below, the fastener 8 of the terminal wire clamp 4 extends through the attachment hole 38 and permits the terminal wire clamp 4 to engage the wire 16 with a substantially planar engagement surface 40 of the load conductor 32. The wire 16 connects with a load that is electrically connected with the circuit breaker 20.

The line conductor 28 is electrically connected with a power source. In circumstances where the line conductor 28 is of a configuration similar to the load conductor 32, such as being of a substantially rectangular cross section and formed with an attachment hole extending therethrough, and if the power source is in the form of a wire, an additional terminal wire clamp 4 may likewise be used to connect the power source wire with the line conductor 28. Nevertheless, the terminal wire clamp 4 need not be operable in cooperation with the line conductor 28 in order to achieve the objects of the present invention.

Figure 1A:
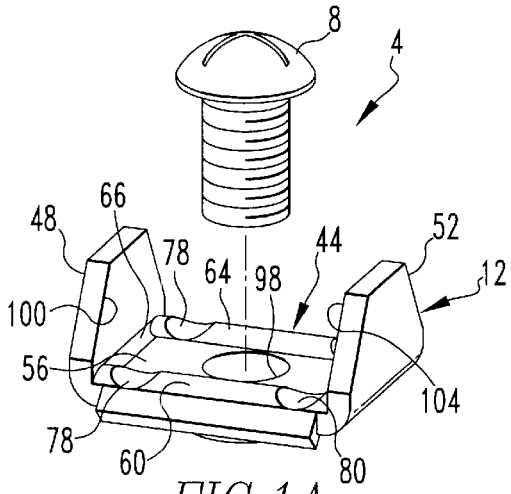
FIG. 1A is an isometric view of a terminal wire clamp in accordance with the present invention.
Figure 2:
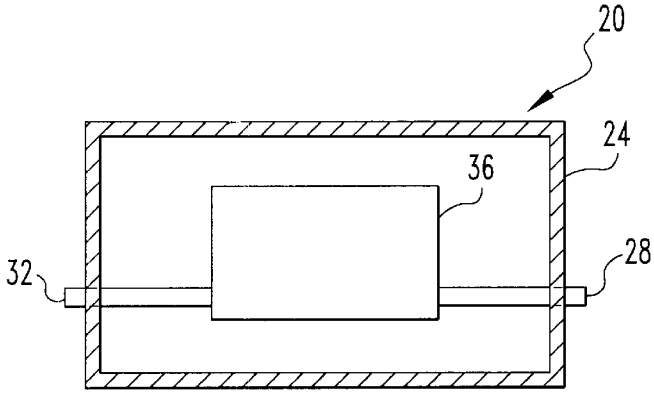
FIG.2 PRIOR ART
FIG. 2 is a schematic representation of a prior art circuit breaker with which the terminal wire clamp of the present invention can be employed.

As is best shown in FIG. 1A, the connection plate 12 includes an engagement member 44, a first ear 48, and a second ear 52. The first and second ears 44 and 48 are disposed at opposite ends of the engagement member 44. The first and second ears 48 and 52 each extend in a direction substantially perpendicular to the engagement member 44 and are substantially parallel with one another. From the configuration of the connection plate 12 that will be set forth more fully below, it will be apparent that the connection plate 12 can be manufactured in any of a wide variety of known methods, and preferably will be manufactured out of a single sheet of material such as steel or another conductor that is subjected to one or more stamping, tapping, and/or other forming operations to form the connection plate 12. Other manufacturing methodologies may, of course, be employed with departing from the concept of the present invention.

Figure 3:
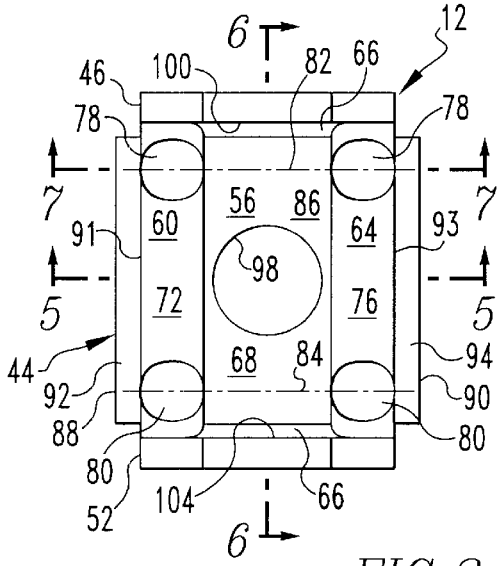
FIG. 3 is a top plan view of a connection plate of the terminal wire clamp.

As is best shown in FIG. 3, the engagement member 44 includes a substantially rectangular primary portion 56, an elongated first rib 60, and an elongated second rib 64. The first and second ribs 60 and 64 extend along opposite sides of the primary portion 56. The primary portion 56 and the first and second ribs 60 and 64 each extend between the first and second ears 48 and 52. As is best shown in FIG. 6, an arcuate fillet 66 may extend between the primary portion 56 and each of the first and second ears 48 and 52, although the existence of such fillets 66 is largely a function of considerations such as ease of manufacturing, conservation of materials, and other such considerations.

The primary portion 56 includes a substantially planar primary surface 68. The first rib 60 includes an arcuate first rib surface 72, and the second rib 64 includes an arcuate second rib surface 76. The first and second ribs 60 and 64 are generally provided to increase the strength of the connection plate 12, as well as for other purposes. The first and second ribs 60 and 64 advantageously each additionally include a first indentation 78 and a second indentation 80 formed into the first and second ribs 60 and 64 for purposes to be set forth more fully below.

From the accompanying figures, it can be seen that the first and second rib surfaces 72 and 76 are in the form of protrusions that extend outwardly from the engagement member 44 beyond the primary surface 68, except for the first and second indentations 78 and 80. In this regard, it can be seen that the first and second indentations 78 and 80 are arcuate and are each tangent to the primary surface 68 (FIG. 6). As such, the first and second rib surfaces 72 and 76 are non-coplanar with and protrude outwardly from the primary surface 68, except for the portion of the first and second indentations 78 and 80 that are tangent to or common with the primary surface 68.

Figure 6:
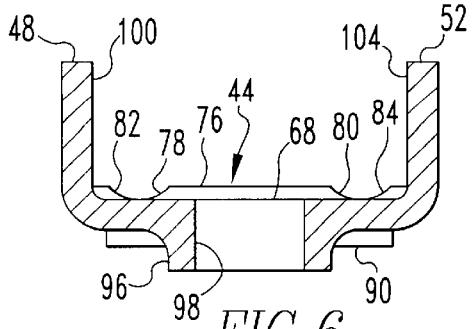
FIG. 6 is a sectional view as taken along line 6—6 of FIG. 3.
Figure 7:
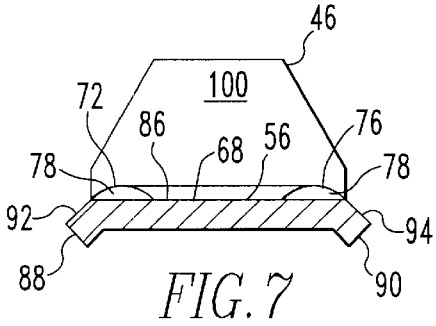
FIG. 7 is a section view as taken along line 7—7 of FIG. 3.

While in FIG. 6 the first and second indentations 78 and 80 are depicted as being tangent to the primary surface 68, it is understood that in other configurations a greater portion of the first and second indentations 78 and 80 may be common with the primary surface 68. It may also be possible in still other configurations for the first and second indentations 78 and 80 to have no parts common with the primary surface 68.

The first indentations 78 formed into the first and second ribs 60 and 64 together form a first retention channel 82 on the engagement member 44. Likewise, the second indentations 80 on the first and second ribs 60 and 64 together form a second retention channel 84 formed into the engagement member 44. The first and second retention channels 82 and 84 thus can be said to extend generally transverse to the first and second ribs 60 and 64.

The first and second retention channels 82 and 84 can also be said to each include both an arcuate component along the first and second indentations 78 and 80, respectively, and a planar component along the primary surface 68. In still other embodiments of the present invention, the primary surface 68 may be configured to include arcuate depressions between the pairs of first and second indentations 78 and 80. It can be seen from FIG. 3 that the first and second retention channels 82 and 84 are substantially parallel with one another and are substantially perpendicular with the first and second ribs 60 and 64.

It thus can be seen that the engagement member 44 includes a connection surface 86 formed thereon that includes the primary surface 68 as well as the first and second rib surfaces 72 and 76, with the first and second rib surfaces 72 and 76 each extending along the first and second indentations 78 and 80 formed by each of the first and second retention channels 82 and 84.

As can further be seen in the accompanying figures, the engagement member 44 further includes a first insertion lip 88 extending from the first rib 60 and a second insertion lip 90 extending from the second rib 64. More particularly, it can be understood from FIGS. 3 and 5 that the first and second ribs 60 and 64 terminate at a first terminal end 91 (FIG. 3) and a second terminal end 93, respectively. It is further understood that the first and second rib surfaces 72 and 76 adjacent the first and second terminal ends 91 and 93, respectively, are oriented at an angle with respect to the primary surface 68. The first and second insertion lips 88 and 90 extend from the first and second terminal ends 91 and 93, respectively.

Figure 4:
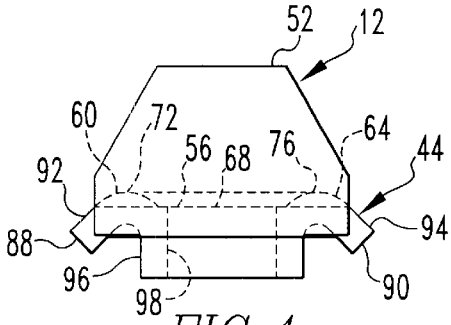
FIG. 4 is a side elevational view of the terminal wire clamp.
Figure 5:
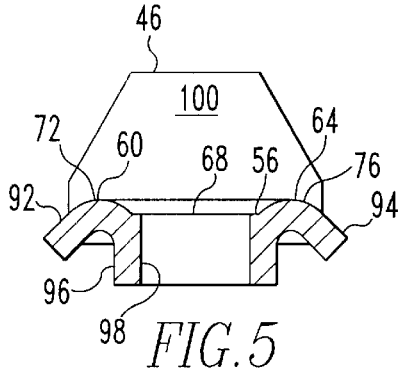
FIG. 5 is a section view as taken along line 5—5 of FIG. 3.

As is best shown in FIGS. 4 and 5, the first insertion lip 88 includes a substantially planar first insertion surface 90 that extends in a direction tangent to the first rib surface 72 at the first terminal end 91. Similarly, the second insertion lip 90 includes a substantially planar second insertion surface 94 that extends in a direction substantially tangent to the second rib surface 76 at the second terminal end 93. The first and second insertion lips 88 and 90 are preferably formed integrally with the engagement member 44, although other configurations may be possible without departing from the concept of the present invention.

Further in this regard, the connection plate 12 may be formed such that the first and second ribs 60 and 64 are in the form of embossments or other stampings, with the first and second indentations 78 and 80 being counter-embossments or regions of the connection plate 12 in the vicinity of the first and second ribs 60 and 64 that are not embossed. It can further be seen from FIG. 5 that the first and second insertion lips 92 and 94 extend from the embossments that form the first and second ribs 60 and 64. As such, the connection plate 12 is advantageously configured such that the wire 16 can be smoothly inserted along either the first or second insertion surface 92 or 94 and can be easily passed through the first or second indentations 78 or 80 without having to overcome any obstruction presented by the first or second ribs 60 or 64.

It is understood, however, that in other embodiments the connection plate 12 may be formed without the first and second insertion lips 88 and 90. It is further understood that the connection plate 12 may also be configured such that the first and second retention channels 82 and 84 are not formed in the first and second ribs 60 and 64. In this latter regard, the first and second retention channels 82 and 84 may be formed in the engagement member 44 without first and second ribs 60 and 64. Alternatively, the first and second ribs 60 and 64 may be oriented substantially parallel with the elongated first and second retention channels 82 and 84.

As is best shown in FIGS. 4–6, the primary portion 56 includes a boss 96 formed thereon that extends away from the primary portion 56 in a direction generally opposite that faced by the primary surface 68. A substantially cylindrical fastener hole 98 extends through the boss 96 and through the primary surface 68. The fastener hole 98 is preferably threaded to cooperate threadably with the fastener 8, which is correspondingly threaded.

Figure 8:
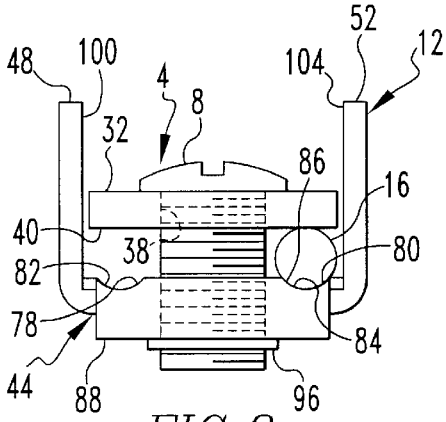
FIG. 8 is a front elevational view of the terminal wire clamp engaging a wire against a load conductor of the circuit breaker.

In this regard, the fastener 8 is depicted in FIGS. 1A and 8 as being a threaded fastener such as a screw that cooperates threadably with the fastener hole 98. It is understood, however, that in other embodiments it may be possible to employ a different type of fastener that is non-threaded, such as a rivet, without departing from the concept of the present invention. It is further understood that in other embodiments of the terminal wire clamp 4 of the present invention, the connection plate 12 and fastener 8 could be of an entirely different configurations. For example, the fastener may be in the form of an adjustable scissors-type device or in the form of a cam that transmits forces to either the connection plate or the conductor. The fastener 8 thus can be of numerous different configurations.

As can further be seen from the accompanying figures, the fastener hole 98 is substantially centrally disposed between the first and second retention channels 82 and 84, and is further substantially centrally disposed between the first and second ribs 60 and 64. The first and second retention channels 82 and 84 are thus each offset from both the boss 96 and the fastener 8 in opposite directions therefrom. As will be understood from the following, the boss 96 and the fastener hole 98 may be located in other positions with respect to the first and second ribs 60 and 64 and the first and second retention channels 82 and 84 without departing from the concept of the present invention.

In use, the terminal wire clamp 4 is mounted on the load conductor 32 by receiving the threaded shank of the fastener 8 through the attachment hole 38 and threadably engaging the fastener 8 with the fastener hole 98 of the connection plate 12 with the connection surface 86 facing the engagement surface 40 of the load conductor 32. The wire 16 is then received in one of the first and second retention channels 82 and 84 such that the wire 16 extends across both of the first or second indentations 78 and 80 thereof. In initially receiving the wire 16 into one of the first and second retention channels 82 and 84, either of the first and second insertion surfaces 92 and 94 of the first and second insertion lips 88 and 90 facilitate the wire 16 being directed to the first or second retention channels 82 and 84, depending upon the position of the connection plate 12 on the load conductor 32.

The fastener 8 is then threadably advanced into the fastener hole 98 and is tightened to engagingly interpose the wire 16 between the load conductor 32 and the connection plate 20 and, more particularly, to electrically conductively engage the wire 16 with the engagement surface 40. In so doing, it can be seen that the first and second ears 48 and 52 are engagable with the sides of the load conductor 32 in order to resist rotation of the connection plate 12 with respect to the load conductor 32 during rotation of the fastener 8 and tightening thereof with respect to the connection plate 12.

More specifically, the first ear includes a first ear surface 100 that is engagable with the load conductor 32, and the second ear 52 includes a second ear surface 104 that is engagable with the load conductor 32. The first and second ear surfaces 100 and 104 are substantially planar and spaced apart and face toward one another. It can further be seen that the first retention channel 82 is substantially parallel with the first ear surface 100, and the second retention channel 84 is substantially parallel with the second ear surface 104. It can further be seen that the first and second ear surfaces 100 and 104 also assist in initially aligning the wire 16 with the first or second retention channels 82 and 84.

As is shown in FIG. 8, with the wire 16 at least partially received in the second retention channel 84 and electrically conductively engaged with the engagement surface 40, the fastener 8 applies an engagement force through the load conductor 32 onto the wire 16, with the engagement force being substantially normal to the primary surface 68. Such a normal force correspondingly causes a first frictional force that acts on the wire 16 in a direction perpendicular to the normal force to resist movement of the wire 16 in the perpendicular direction. Additionally, the regions of the first and second rib surfaces 72 and 76 lying along the second indentations 80 provide additional frictional surfaces that cause second frictional forces to resist movement of the wire 16 in the perpendicular direction.

If similar wires 16 occupy both the first and second retention channels 82 and 84 prior to tightening the fastener 8, upon tightening the fastener 8 the primary surface 68 will remain substantially parallel with the engagement surface 40 since the fastener 8 will apply substantially equal engagement forces through the load conductor 32 to both wires. In such a configuration, the forces from the fastener 8 applied through the load conductor 32 that are normal to the primary surface 68 will provide the aforementioned first frictional forces perpendicular to the normal force, and the first and second indentations 78 and 80 will provide the aforementioned second frictional forces, both of which resist movement of the wires in the direction perpendicular to the normal.

If, however, only one of the first and second retention channels 82 and 84 has a wire 16 therein when the fastener 8 is tightened (such as the configuration depicted generally in FIG. 8), further tightening of the fastener 8 often will have a tendency to cause the connection plate 12 to pivot with respect to the load conductor 32 such as is depicted generally in FIG. 1. Nevertheless, the first and second ribs 60 and 64 are configured to be of sufficient height, with the first and second retention channels 82 and 84 correspondingly being of sufficient depth, that the first and second retention channels 82 and 84 still provide the second frictional forces to the wire 16 despite any such pivoting. As such, the advantageous configuration of the connection plate 12 with the first and second retention channels 82 and 84 resists loosening of the wire 16 after the fastener 8 has been tightened, which correspondingly minimizes the likelihood that the wire 16 may become partially electrically disengaged from the engagement surface 40 whereby it otherwise could potentially create a hot spot due to arcing and other phenomena.

It thus can be seen that the configuration of the terminal wire clamp 4 with the elongated first and second retention channels 82 and 84 imparts to the wire 16 retained therein both a first frictional force due to the normal force transmitted from the fastener 8 through the load conductor 32 to the wire 16, as well as a second frictional force that results from the engagement of the wire 16 against the sides of the first or second indentations 78 or 80. The first and second retention channels 82 and 84 thus constitute structures that provide additional frictional forces to retain the wire 16 therein and to resist movement of the wire 16 or partial disengagement thereof from the engagement surface, 40 after tightening of the fastener 8 despite any pivoting of the connection plate 12 with respect to the load conductor 32.

While a particular embodiment of the present invention has been described herein, it is understood that various changes, additions, modifications, and adaptations may be made without departing from the scope of the present invention, as set forth in the following claims.

What is claimed is:

1. A terminal wire clamp structured to electrically conductively engage a wire with a conductor, the terminal wire clamp comprising:

a fastener;

a connection plate;

the fastener and the connection plate being cooperable with one another to electrically conductively engage the wire with the conductor;

the connection plate having a connection surface;

the connection surface including a first retention channel formed into the connection plate;

the connection surface being structured to engage the wire and at least partially receive the wire in the first retention channel, the first retention channel being structured to resist movement of the wire when the connection plate engages the wire with the conductor; and the connection plate includes an engagement member having a primary portion and a first connection plate includes an engagement member having a primary portion and a first rib, the primary portion including a substantially planar primary surface, and the first rib including an elongated first rib surface, the first rib surface protruding outwardly from the primary surface and extending at least partially in a direction non-parallel with the first retention channel, the connection surface including the primary surface and the first rib surface, the first retention channel being formed into the first rib.

2. The terminal wire clamp as set forth in claim 1, in which the engagement member includes a second rib, the second rib having an elongated second rib surface protruding outwardly from the primary surface, and in which the first retention channel is formed across both the first and second ribs.

3. The terminal wire clamp as set forth in claim 2, in which the first and second rib surfaces are oriented substantially parallel with one another.

4. The terminal wire clamp as set forth in claim 1, in which the first retention channel is tangent to the primary surface.

5. The terminal wire clamp as set forth in claim 4, in which the first rib is a first embossment.

6. The terminal wire clamp as set forth in claim 5, in which the first embossment includes a terminal end, the first rib surface at the terminal end being oriented at an angle with respect to the primary surface.

7. The terminal wire clamp as set forth in claim 6, in which the engagement member includes a first insertion lip extending from the terminal end of the first embossment.

8. The terminal wire clamp as set forth in claim 7, in which the first insertion lip includes a first insertion surface extending from the terminal end of the first rib surface, the first retention channel being tangent with the first insertion surface.

9. The terminal wire clamp as set forth in claim 8, in which the engagement member includes a second rib having an elongated second rib surface protruding outwardly from the primary surface, the second rib being a second embossment, the connection surface including a second retention channel formed into the connection plate, the first and second retention channels each being formed across both the first and second ribs.

10. A circuit breaker comprising:

a line conductor;

a load conductor;

an operating mechanism operatively interposed between the first and second conductors; and a terminal wire clamp structured to electrically conductively engage a wire with one of the lines and load conductors;

the terminal wire clamp including a fastener and a connection plate that are cooperable with one another;

the connection plate having a connection surface including a first retention channel formed into the connection plate;

the connection surface being structured to engage the wire and at least partially receive the wire in the first retention channel, the first retention channel being structured to resist movement of the wire when the connection plate engages the wire with the one of the line and load conductors; and the connection plate includes an engagement member having a primary portion and a first rib, the primary portion including a substantially planar primary surface, and the first rib including an elongated first rib surface, the first rib surface protruding outwardly form the primary surface and extending at least partially in a direction non-parallel with the first retention channel, the connection surface including the primary surface and the first rib surface, the first retention channel being formed into the first rib.

11. The circuit breaker as set forth in claim 10, in which the engagement member includes a second rib, the second rib having an elongated second rib surface protruding outwardly from the primary surface, and in which the first retention channel is formed across both the first and second ribs.

12. The circuit breaker as set forth in claim 11, in which the first and second rib surfaces are oriented substantially parallel with one another.

13. The circuit breaker as set forth in claim 10, in which the first retention channel is tangent to the primary surface.

* * * * *